US005290006A

United States Patent [19]

Gouker

[11] Patent Number: 5,290,006

[45] Date of Patent: Mar. 1, 1994

[54] EXPANDING FORM FOR POURING MIXED CEMENT TO REPOSITION MANHOLE CASTINGS

[76] Inventor: Clifford Gouker, 101 Buena Vista Dr., Freedom, Calif. 95019

[21] Appl. No.: 887,581

[22] Filed: May 20, 1992

Related U.S. Application Data

[63] Continuation-in-part of Ser. No. 563,781, Aug. 3, 1990, abandoned, which is a continuation-in-part of Ser. No. 401,760, Sep. 1, 1989, abandoned.

[51] Int. Cl.[5] ..... B28B 7/30

[52] U.S. Cl. ..... 249/63; 249/146; 249/152; 249/178; 249/180; 249/184; 249/188

[58] Field of Search ..... 249/48, 49, 152, 153, 249/178, 179, 180, 184, 186, 146, 64, 63, 147, 150, 188; 425/577, DIG. 10

[56] References Cited

U.S. PATENT DOCUMENTS

| | | | |
|---|---|---|---|
| 680,273 | 8/1901 | Parker | 249/152 |
| 767,418 | 8/1904 | Miller | 249/152 |
| 824,855 | 7/1906 | Foster et al. | 249/152 |
| 858,638 | 9/1906 | Swenson | 249/153 |
| 904,900 | 5/1907 | Sheets | 249/152 |
| 946,002 | 3/1908 | Blau | 249/179 |
| 948,539 | 12/1908 | Clark | 249/179 |
| 1,007,187 | 10/1911 | Cross | 249/152 |
| 1,118,630 | 11/1914 | Brawner | 249/184 |
| 1,458,145 | 6/1923 | Parsons | 249/152 |
| 1,861,801 | 7/1932 | Jury | 249/180 |
| 2,032,637 | 3/1936 | Schuster | 249/152 |
| 3,205,552 | 9/1965 | Johnson et al. | 249/152 |
| 3,669,402 | 6/1972 | Paulon | 249/178 |
| 3,729,165 | 4/1973 | Trimple | 249/144 |
| 3,733,045 | 5/1973 | Marin | 264/30 |
| 3,734,450 | 5/1973 | Lengel | 249/144 |
| 3,749,352 | 7/1973 | Khodosh et al. | 249/180 |
| 3,847,339 | 11/1974 | Farrell | 249/179 |
| 4,278,229 | 7/1981 | Burlett | 249/102 |
| 4,365,780 | 12/1982 | Williams | 249/11 |
| 4,685,650 | 8/1987 | Ditcher | 249/83 |
| 4,824,068 | 4/1989 | Ferland | 249/2 |

FOREIGN PATENT DOCUMENTS

| | | | |
|---|---|---|---|
| 438540 | 1/1975 | U.S.S.R. | 249/178 |
| 853055 | 8/1981 | U.S.S.R. | 249/178 |

*Primary Examiner*—Khanh Nguyen

[57] ABSTRACT

A lightweight metal or plastic form that when collapsed can be installed on the inside of a temporarily suspended manhole casting and expanded by a mechanism having numerous arms connected at a center point and extending outwardly to spaced and positioned spring encasing brackets that compensate and adjust slightly the pressure that the arms project to the outer walls of a slotted circular shaped form. By a cam effect the handle locks into a over center position that is maintained without the aid of clamps or additional hardware so that the form will stay in position until the user lifts the handle upwardly which removes the device from the manhole and at the same time collapses the form. The inventions primary purpose is to provide a seal between a temporarily blocked up manhole metal casting and the manhole precast concrete riser rings so that cement may be applied around the outside of the manhole and vibrated into position without danger of any cement contaminating or plugging the sewer system. Other features include quick installation and speedy removal along with reusability yielding cost effectiveness.

4 Claims, 3 Drawing Sheets

EXPANDING FORM FOR POURING MIXED CEMENT TO REPOSITION MANHOLE CASTINGS

This application is a continuation-in-part of application Ser. No. 07/563,781, filed Aug. 3, 1990, now abandoned, which is a continuation-in-part of Ser. No. 07/401,760 filed Sep. 1, 1989, now abandoned.

FIELD OF THE INVENTION

The present invention is directed to a lightweight metal form that when collapsed can be installed on the inside of a temporarily blocked up manhole cover and casting assembly and expanded, so that mixed cement can be placed and vibrated and not fall into the sewer system. Once this purpose is accomplished and the concrete has become set, the form can be collapsed and easily removed.

BACKGROUND OF THE INVENTION

Sewer systems in the United States are typically constructed of sections of plastic, tile or cement pipe connected and bedded below the ground surface for the transmission and directional flow of waste water. Access to this system is achieved by precast sections of large diameter concrete pipe manufactured in various standard heights and stacked atop one another so any desired distance from ground level of the live sewer can be obtained for inspection or maintenance. This is commonly called a manhole. Once the sections of the manhole are placed and bedded with compacted sand, gravel or loam material, a metal casting and a cover lid, with standard dimensions is set in place so that it inner fits with the precast riser rings of the manhole. This casting assembly is engineered and installed so that it is flush or even with the roadway. This casting assembly is commonly referred to as a manhole cover. Due to varying surface conditions and the changing elevation found necessary to arrive at an engineered percent of fall for natural flow, the casting assembly is positioned above the flow line at predetermined elevations. The precast riser rings mentioned in line eighteen of page one can presently be obtained in heights of two, three or six inch variations to achieve an approximate finished elevation at the manhole cover. However, exact finish elevation can not be achieved by this precast product. Therefore it is common in the construction industry to use small cement or steel blocks to temporarily position the manhole casting at the desired elevation above the precast riser rings and mixed cement is poured into the void created by the blocks. In the past, to avoid uncontainable cement from falling into the sewer system a wooden form is constructed and placed inside the riser rings. Many times no form at all is used. With this method the cement is mixed very stiff and pushed into the void by hand and can not withstand much vibration which increases the density and the eventual strength of the concrete.

Another common situation requiring the relocation of a manhole casting assembly is when a asphalt roadway needs to be paved again or as the industry calls it "overlaid". All manholes must be chipped out with jackhammers and raised up as much as ten inches to match and be flush with the new pavement. If the road bed needs to be leveled or a change in the grade is required, the manholes castings finish elevations may need to be decreased or lowered. Sometimes a fraction of an inch is necessary for arriving at proper finished elevation and the precast riser rings are ineffective.

Although the desirability of being able to have a lightweight, reusable form that can be easily installed and expanded to contain vibrated cement for this procedure, no one has been able to provide a suitable apparatus with an instantaneous locking feature for this specialized forming operation. This invention allows a handicapped individual with limited knowledge and strength or a person with one arm to accomplish the forming operation. Alternatives to this concept of a standardized collapsible unit is a costly and time consuming process to perform this task. These methods include thin strips of plywood or metal curved and formed to the shape of the inside of the manhole and held in place by a plurality of nails and braces, which if not properly installed can fall and risk plugging a sewer pipe. Known designs are generally for large diameter applications and require extra tools to facilitate their use and equipment to place a form in position.

In addition the present invention is intended to assist with the alignment of the metal casting assembly with the riser rings, thereby performing another useful function. As well, this invention shall not be limited to the relocation of manholes, but upon their initial installation.

PRIOR ART STATEMENT

The following described prior art patents are believed to be pertinent to the type of invention which is presented herein.

The patent to Williams (U.S. Pat. No. 4,365,780) is directed to the positioning of removable forms for the purpose of making holes in concrete so that items such as steps may be attached.

The Khodosh patent (U.S. Pat. No. 3,749,352) shows an arrangement of hinges and joints pressing separate members in an outwardly direction with the ability of a collapsible form.

The patent to Trimble (U.S. Pat. No. 3,729,165) is a series of inner and outer steel plates that form the entire manhole encompassing the distance from the actual sewer pipe to just below the ground surface.

The Ditcher patent (U.S. Pat. No. 4,685,650) has to do with the forming of inverts of a manhole section which adjust and can be positioned.

The patent to Burlett (U.S. Pat. No. 4,278,229) is directed to forming a full height manhole including various inverts at the base or bottom.

The patent to Lengel (U.S. Pat. No. 3,734,450) involves the expansion of a segmented form for pouring cylindrical designs including a detachable expanding device.

The patent to Sheets (U.S. Pat. No. 904,900) teaches a number of threaded arms of the same length positioned radially from a centered axial shaft or rod with locking nuts exerting pressure on the annular wall he describes as a hinged, three piece shell. He does not employ any springs attached to connecting arms of different lengths pinned to a off centered located handle lifting device. My springs are located in a receptacle and press outwardly during the molding operation and contribute to a instantaneous locking feature incorporated in the handle lifting device through connecting arms of different lengths.

The patent to Swenson (U.S. Pat. No. 858,638) claims a two piece forming apparatus that requires the use of a curved handle pivotal mounted on the outside of the annular wall, restricting access after vibrated cement had hardened and preventing a smooth continuous transition of cement from manhole riser rings to manhole castings when the form is removed, thereby producing irregular shapes in the finished product. He teaches a locking bar that is unrelated to a handle lifting device to secure the form in a given position.

The Jury patent (U.S. Pat. No. 1,861,801) brings forward the idea of a form unrelated to manhole castings employing a spring to assist in the ease of collapsing the device and is not related to any locking mechanism.

The Palsun patent (U.S. Pat. No. 3,669,402) is a forming device with several independent components and the use of a spring that is not connected with a handle or lifting device incapable of locking the device into the expanded position.

The Clark patent (U.S. Pat. No. 948,539) describes the twisting of a centered rod extending the full length of the mold to force arms outwardly, thereby expanding the mold or form without the assistance of springs to evenly distribute pressure or assist in an instantaneous locking mechanism such as mine.

The Farrell patent (U.S. Pat. No. 3,847,339) teaches a lever mounted on the inside of the annular wall, that with the use of a cam device expands the annular wall and does not employ the use of springs to distribute even outward pressure or to assist in locking the invention in an expanded position. He has a pair of laterally projecting ledges that contact a pair of connected channels or rails do not permit exact centering and the threaded J-bar and butterfly nuts of insufficient strength to secure such a apparatus during vibration. The handle is as well not the single lifting device and the use of the invention is predicated on other functioning components.

The Soviet Union Patent (438540) teaches a spring to link a threaded worm drive system to a plurality of inserts and is not associated with any instantaneous locking feature operably invoked by a single lifting device or handle that is positioned off center and connected to arms of different lengths.

SUMMARY OF THE INVENTION

This invention is directed to a novel forming assembly which can be quickly installed and expanded to the confines of two separate precast sewer riser sections in a expanded or locked position to contain vibrated cement.

It is comprised of a overlapping lightweight annular wall with four arms at two different lengths, positioned radially and attached at one end to a pivoting hinged handle and on the other end to four each independent spring receptacles or bracket assemblies spaced and welded to the inside of the annular wall or form. The tee shaped handle is ¼" thick metal stem with a round ¼" stem with a ⅛" thick flat plate measuring 1" by 1" welded at the base of the stem above a bracket or yoke that is ½" between the yoke ears to accept four ⅛" arm ends that link the handle to each spaced spring bracket receptacle assemblies the inside of the annular wall. The bracket or yoke below the stop plate is bored or drilled with a ¼" hole to accept a pin. Two of the flat metal arms that connect the handle and yoke to each spring receptacle assembly are ten and one half inches long and two arms are ten inches long. In the present invention, all of the arms are ¾" tall and ⅛" in thickness with ¼" holes drilled in each first and second ends to accept a single pin that attaches it to the handle on one end and the slotted spring receptacle on the other. Each arm is bent slightly at approximately 45 degrees on one end at its intersection with the handle and secured with a single round pin. The arms are positioned on edge, meaning the narrow or ⅛" edge upward and perpendicular to the horizontal plane, in the same vertical direction as the annular wall is understood to be on edge. As if spokes on a wheel, the four connecting arms are positioned equidistant in a crossing configuration when pinned to the handle and each slotted spring receptacle brackets on the inside of the annular wall, thereby locating the handles intersection with the four connecting arms off center on the interior of the annular metal wall. It is off of the imaginary vertical line extending through the center in the interior of the annular wall and is not at the midpoint of the imaginary horizontal plane on the interior of the annular wall meaning the radius would not be the same if measured to different points across the annular wall. Below the tee shaped handle is a flat ⅛" thick plate measuring 1" by 1" that is positioned and welded to the stem of the handle above the pinned yoke intersection of the connecting arms, providing a stop or limiting block, designed to restrict the travel of the handle and arms to approximately three inches below the horizontal plane. Horizontal plane is understood to be when the arms are perpendicular or 90 degrees to the annular wall and the invention is at maximum expansion.

The locking feature is accomplished by two of the longer arms positioned and equally spaced along side one another and the two shorter arms positioned in the same manner across from the longer arms in a crossing manner so that the lengths do not alternate. The approximate 45 degree bend in a single end of each of the four arms is for the purpose of alignment of the holes to be pinned to yoke of the hinged handle below the flat limiting block or plate with a single rod, pin or screw. When all four bent ends are pinned to the handle it becomes a hinge or pivot point that positions the handle in an off center location with reference to the circular shape of the annular wall. The four each outer or opposite ends of each radially positioned arms are attached to four each slotted spring receptacles or brackets with four solid pins secured by a cotter key and washers. A spring positioned and contained within the recess of each of the four each spring receptacles and biassingly press against the annular wall when the elongated metal arms are at or immediately below the horizontal plane.

These spring receptacles are welded to brackets having curved outer surfaces that are at the same radius or same curvature as the inside surface of the annular metal wall and are attached by welding, rivets or glue if made out of plastic. The four curved brackets or plates are located mid way or at the center of vertical height of the annular wall providing equal pressure to all areas of the outside surface of annular wall of the invention. The spring receptacles or housings are of a square tubular shape and enclose a metal coil spring. The receptacles are also slotted horizontally to accept the straight or unbent ends of the connecting arms to be pinned and the pin is allowed to travel against the spring. The receptacles are also slotted vertically to allow the travel of each arm up and down in a hinging arc as the handle is depressed or lifted.

The mortised horizontal slots in the spring receptacle are approximately ¼" wide and 2" long and allow for the straight or unbent drilled end of each arm to be secured with a solid anchor pin the same length as the width of the receptacles rectangular tubing, permitting travel in two directions as the spring is compressed and relaxed.

The vertical slots in the top and bottom of the spring receptacle are wide enough to allow each ⅛" thick metal arm to pivot in an arc from the hinge point at the traveling anchor pin. The upper vertical slot allows the handle connected to the arms to travel upward, thereby reducing the circumference and diameter of the annular wall into the compressed position. The lower vertical slot in the bottom of the tubular spring receptacle is wide enough to permit each ⅛" wide arm to travel downward or below the horizontal plane. Understand that when the arms, connected to the handle are at a horizontal plane, meaning at a right angle or perpendicular to the annular wall, the springs are fully compressed and the form is at its maximum expanded circumference and diameter. As the handle travels or cams over and locks in the first position below the horizontal plane the spring pressure attempts to force the handle and arms farther down, below the horizontal plane without any manpower required. The handle will travel a length of approximately 3" until the flat plate that is welded under the handle and above the yoke intersection of the arms contacts the connecting arms providing a limit stop, thereby locking or maintaining the spring pressure to hold the handle and connected arms just below the horizontal plane. At this first locked position the annular wall in the expanded position and the spring tension against the flat metal 1" by 1" by ¼" plate below the handle prevents further downward movement to a point where the four each independent springs could become relaxed and the annular wall not in the maximum expansive state. The 27 pound invention can be lifted by the handle with the strength of a average mans arm and hand and also can lowered to the below ground location which is the inventions intended position of use and easily expanded.

The four springs are an equalizing members within the recess of a receptacle that exert equal pressure throughout the circumference of the annular wall of the invention. The springs are of the character that they can be overcome in the first locked position by the strength of one man's arm to lift up the handle, thereby reducing the diameter and circumference allowing the invention to be lifted from the intended position of use after the vibrated cement has solidified or hardened. The handle in cooperation with the elongated metal arms, brackets enclosing a spring in the recess of the receptacle pressing on the annular wall is the single lifting device requiring no wrenches or machinery to put the invention in use.

The outside of the form that comprises the annular wall is designed to expand by being constructed of a rectangular flat piece of lightweight, galvanized material approximately 1/16" thick which is rolled circular and overlapped and riveted at the point of intersection. The outer or overlapping end of the circular form is slotted to provide a number of elongated holes held in position by a larger washer that will not go through the slot but is not compressed so tight as to prevent the sliding motion when the handle is being locked down into the first locked position or released by lifting upward on the handle lifting device. Therefore, depending on the position of the handle mechanism which expands the form, the various slots in the outer overlapping section of the form may move separate and independent from the inner riveted section of the metal annular wall. The invention weighs approximately 27 pounds.

The top edge of the form wall has a lip or angled tabs that inner fit into the manhole casting assembly. These outwardly bent tabs are for the purpose of exact alignment of the manhole cover casting directly over the riser rings.

The invention has the added useful feature of being placed in an existing manhole and expanded while the concrete of the manhole casting is jack hammered out from the outside of the riser rings prior to relocation. The function of this invention is intended to prevent the sewer system from being contaminated by broken pieces of existing riser rings and broken segments of concrete from falling down the manhole and plugging the sewer system during the removal of the casting assembly prior to it being repositioned or relocated at a preferred elevation.

Other features and advantages of the present invention will become apparent from the following detailed description when it is considered in conjunction with the accompanying drawings.

BRIEF DESCRIPTIONS OF THE DRAWINGS

DETAILED DESCRIPTIONS OF THE DRAWINGS

Figure 1:
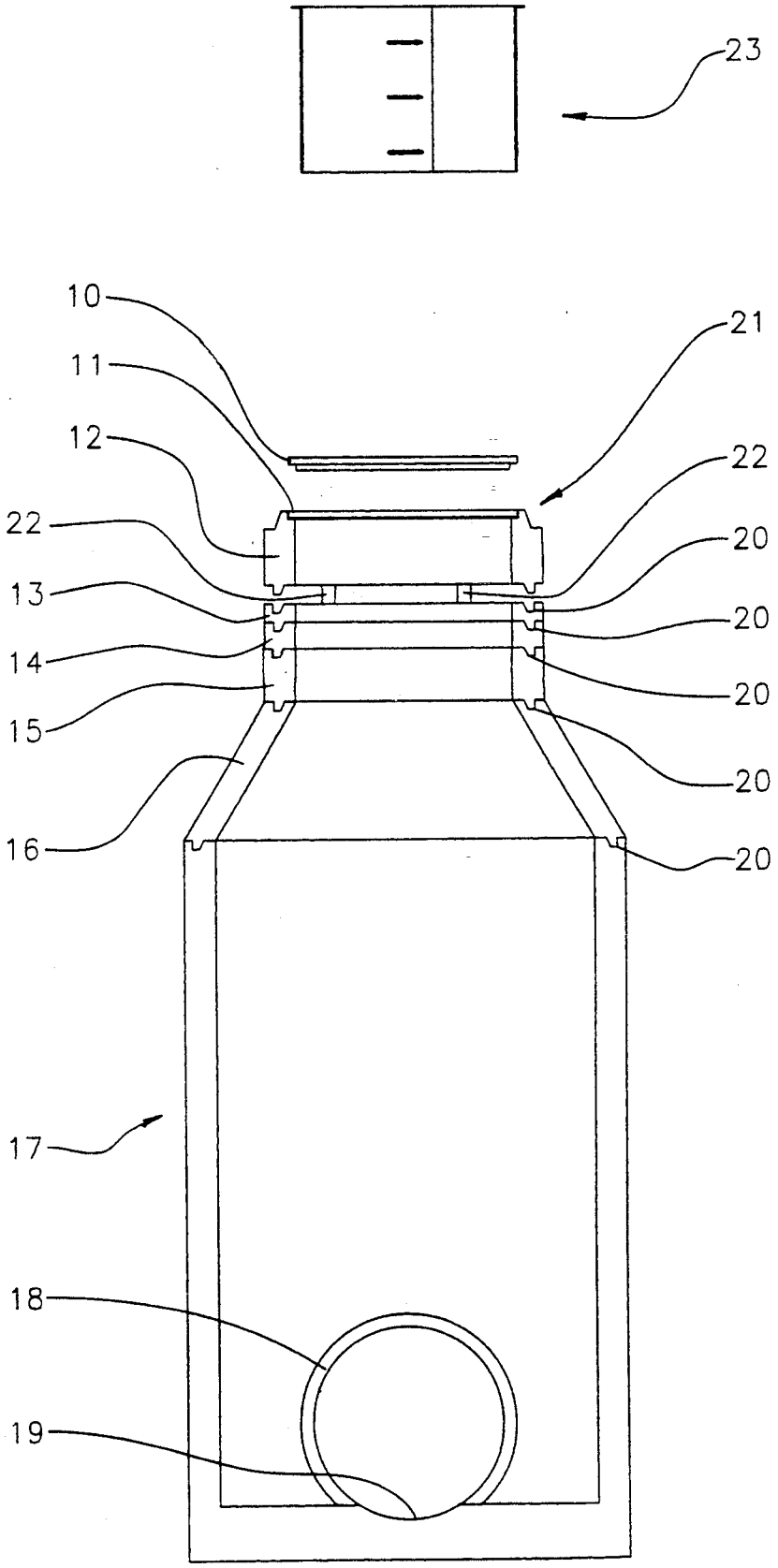
FIG. 1 is a cross sectional view of typical precast sections of a manhole with the present invention form apparatus side view positioned above it.

Turning now more specifically to the drawings, FIG. 1 shows a typical precast concrete manhole assembly 17, comprised of precast concrete risers rings 13,14,15 which have standard dimensions and various heights for adjustability with regard to the flow line 19, and the top of the finished elevation which will be at street level or the top surface of 10 which is a typical manhole cover and a component with 12, understood to be the manhole casting ring that has a relieved depression 11 to accept and be flush with the lid 10. The manhole casting assembly 21, which is comprised of the ring 12, and the cover lid 10, which when raised up above the tapered manhole cone 16, and any combination of the riser rings 13, 14,15, on metal or concrete blocks 22, for temporary support to arrive at the proper elevation. Each section of the manhole as a general rule has an alignment groove which fits and interlocks with a typical mating lip extended at their intersection 20. Number 18 in the drawings is to depict the sewer pipe that intersects the walls of the manhole 17. Number 23 also shown in FIG. 1 is a to-scale side elevation view of the invention shown here in the expanded position prior to installation. As you can see, the invention 23, could be compressed and lowered into the manhole and expanded which align the manhole casting assembly 21, with riser rings 13,14 and 15 and provide a seal tight enough that no cement could fall down into the sewer below, when poured around the outside and vibrated into place.

Figure 2:
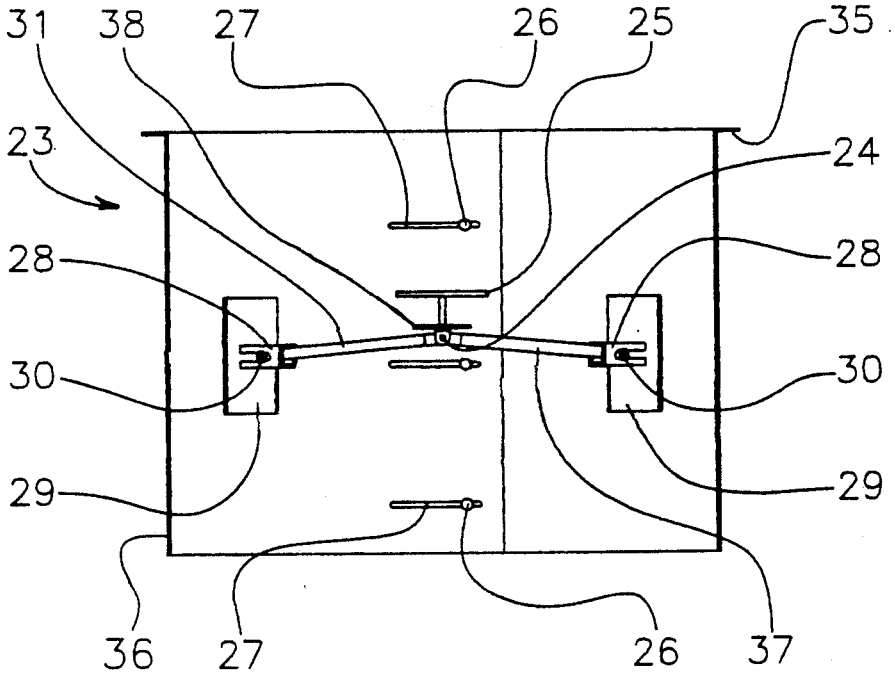
FIG. 2 is a partial cross sectional view of the present invention depicting the components and features that expand and retract the apparatus.

FIG. 2 is a cross sectional view of 23, with the interior moving components and handle assembly 25. The invention 23, is a thin material circularly formed and overlapped and fastened by a series of rivets 26, through a plurality of elongated holes or slots 27, producing the slidability needed to be adjustable.

The top edge or lip of the invention 23, has outwardly bent tabs 35, that prevent the annular wall 23, from moving from its intended position, understood to be surface 11, of casting assembly 21 in FIG. 1. The mechanism that increases and decreases the circumference of the annular wall of the invention consists of numerous separate metal arms of two different lengths shown here as 31 and 37, pinned at a off center point to a Tee shaped handle 25, bored to accept a pin 24, connecting the arms 31 and the two arms of a different length 37, to one another and to the handle 25, in a hinging fashion. These arms 31 and 37, are drilled on each first and second end, extend radially in an outward direction into a grooved and slotted spring bracket receptacle 28, attached by means of a round pin 30, and solidly affixed to the circular form walls 36, by a bracket plate 29.

The arms 31 and 37, are positioned mid way or at the center of vertical height of the invention 23, so that the pressure exerted will be evenly distributed to brackets 29, and to the annular wall 36. It is understandable that the sharper degree of the angle between the arms 31 and 37, and the spring bracket 28, the smaller the diameter of form 23. As well it can be understood that as the handle mechanism 25, moves in a downward fashion as when the user installs the device 23, the more the circumference will increase. Due to the length and positioning of the four arms 31 and 37, into the slotted spring brackets 28, and their relative position when extended past horizontal plane the handle 25, has a stop plate 38, welded to the stem above pin 24, and acts as a limiting block as the springs 32 in FIG. 4, attempt to force the handle mechanism 24 and 25, further past the horizontal plane, they cam over into a fully extended first locked position.

When the device 23, is to be removed from the manhole after its intended purpose has been accomplished, the user need only to pull upwardly on handle 25, which will raise the arms 31 and 37, and by virtue of design, reduce the circumference of the device.

Figure 3:
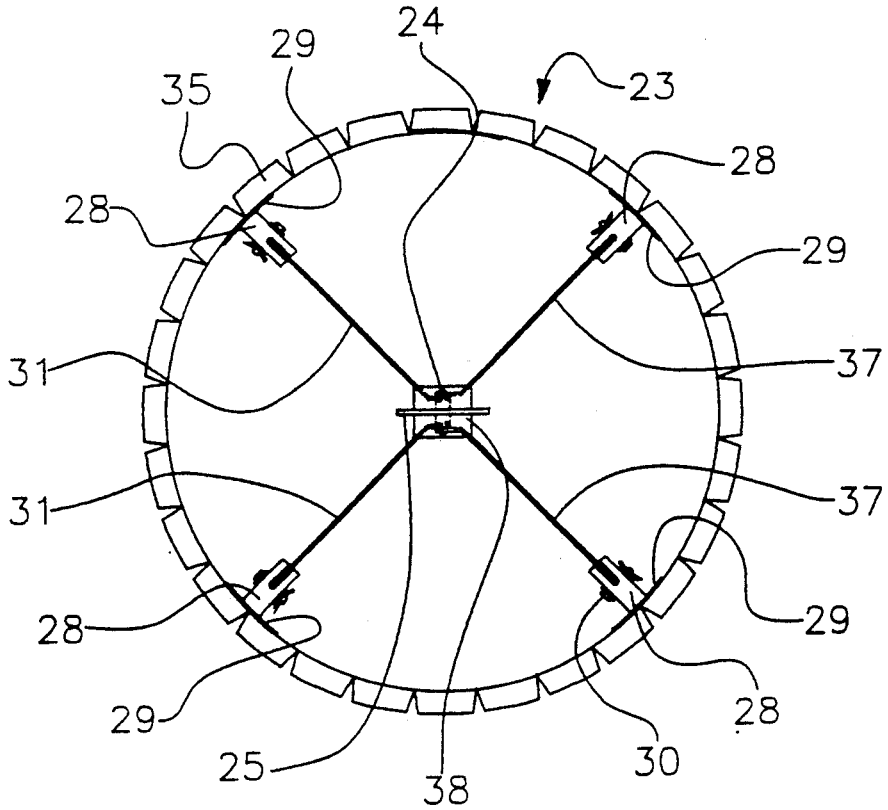
FIG. 3 is a top view showing the tabs forming a lip and the handle in relation to the radial arms attaching to the spring bracket at the form wall.

FIG. 3 is a top view of the invention 23, which consists of a plurality of arms or members 31 and 37, connected and hinged at the center handle 25, by pin 24 and extending outwardly to the slotted spring brackets 28, and solidly attached to the wall 36, by means of the bracket plate 29. The top view of the spring bracket 28, show the relative position of the slots or mortised areas in relation to the intersecting arms 31 and 37, that are pinned into position by pin 30, to give vertical arc movement to arms 31 and 37 and horizontal travel of pin 30 as the spring 32 expands and contracts.

Figure 4:
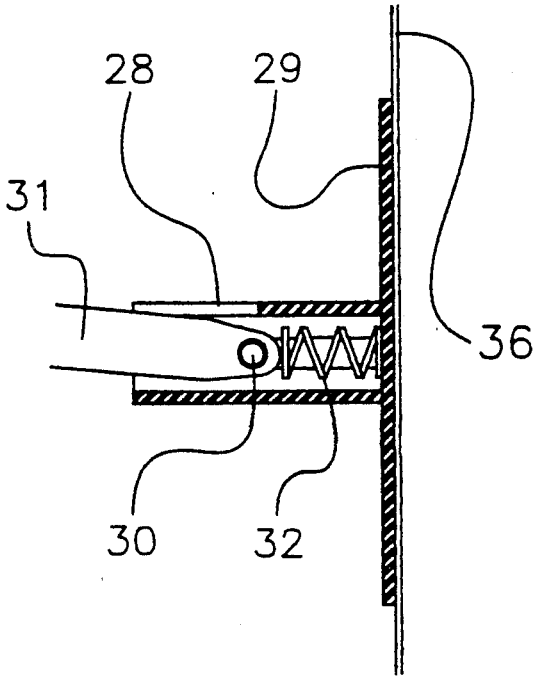
FIG. 4 is a partial cross sectional side view of the radius arm coupled to the tensioned, slotted brackets.

FIG. 4 is a side elevation of spring bracket 28, depicting spring 32, that compresses when arm 31 or 37, is pressed downward and extended outwardly through receptacle spring bracket 28, that holds it into the slot needed for horizontal travel of pin 30.

Figure 5:
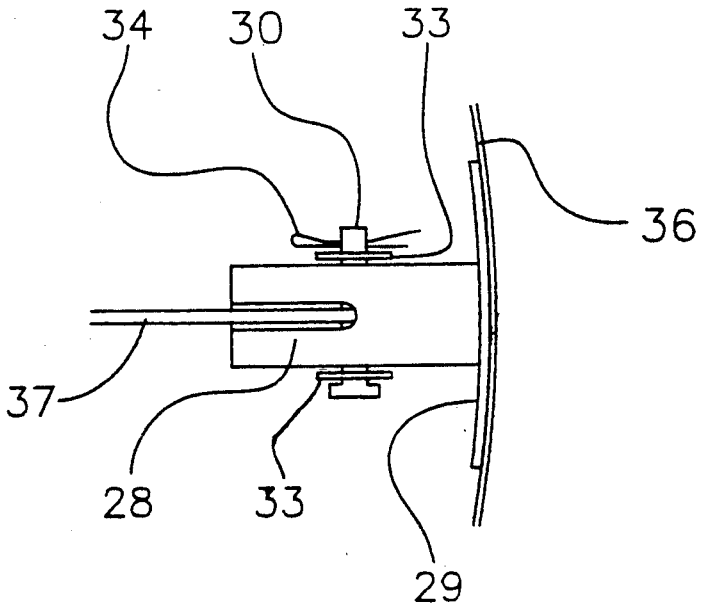
FIG. 5 is a top view of the radius arm coupled to the spring bracket at the form wall.

FIG. 5 is a top view of spring bracket 28, with arm 31 or 37, secured in position by pin 30, washers 33, and cotter pin 34.

While the above description contains many specificities, these should not be construed as limitations on the scope of the invention, but rather as an exemplification of one preferred embodiment thereof. Many other variations are possible, for example the form could be constructed of plastic or the mechanism could be actuated using an air operated cylinder or similar means to expand the above stated invention. Accordingly, the scope of the invention should be determined not by the embodiment illustrated, but by the appended claims and their legal equivalents.

I claim:

1. A manhole forming assembly comprising an annular metal wall 1/16 inch in thickness having two ends that slideably overlap;

four radial, elongated, flat, metal connecting arms equiangularly disposed within the interior of the metal wall, wherein two of said arms which positioned adjacent to each other are identical, each having a length of 10½ inches and wherein the other two arms are identical, each having a length of 10 inches, each of said four connecting arms further including a first end and a second end;

a plurality of curved spring receptacles secured to the annular wall, each having a recess;

first linking means for linking each of said first ends to each of said spring receptacles;

a lifting handle located off center within the interior of annular wall;

second linking means for pivotally linking said second ends to said lifting handle and a plurality of springs, each located in each of said recesses of the receptacles to resiliently bias against each of said first ends of said connecting arms wherein each of said receptacles includes a slot allowing a respective connecting arm to pivot within the recess, wherein a locked position is created when the handle is depressed downwardly to move the annular wall into an expanded position, and wherein when the handle is pulled upward the annular wall is unlocked and moved to a retracted position.

2. The manhole forming assembly according to claim 1 wherein the first linking means includes a plurality of pins, each linking each of said first ends of said connecting arms within the receptacle to each of said springs; and each of said receptacles is secured to the annular wall by a receptacle plate.

3. The manhole forming assembly according to claim 1 wherein the handle is a single lifting device having a thickness of ¼ inch to lift said 1/16 inch thick annular wall from an intended position below a ground level; and wherein the single lifting device includes a T-shaped handle having a stem and a metal plate affixed to an end of the stem and located above the second linking means, said metal plate providing a limit stop of said second linking means.

4. The manhole forming assembly according to claim 1 wherein the annular wall has a weight of about 27 pounds and the handle defines a pivot point to reduce the circumference of the annular wall as it is lifted from an intended position below a ground level.

* * * * *